United States Patent [19]

Sarno

[11] 4,403,955

[45] Sep. 13, 1983

[54] RECEPTACLE FOR SUPPORT OF A MELT CONTAINING CRUCIBLE

[75] Inventor: Nicola Sarno, Vancouver, Wash.

[73] Assignee: General Signal Corporation, Stamford, Conn.

[21] Appl. No.: 350,797

[22] Filed: Feb. 22, 1982

[51] Int. Cl.[3] ..... F27B 14/08; F27B 14/14

[52] U.S. Cl. ..... 432/158; 248/311.2; 266/275; 428/35; 428/33; 432/264

[58] Field of Search ..... 432/262, 264, 158; 422/248; 156/83; 266/275, 274; 248/311.2, 314, 146; 428/35, 64, 33, 119, 408

[56] References Cited

U.S. PATENT DOCUMENTS

| | | | |
|---|---|---|---|
| 222,175 | 12/1879 | Bower | 432/158 |
| 2,406,334 | 8/1946 | Keller et al. | 248/311.2 |
| 3,163,393 | 12/1964 | Strong | 248/314 |

FOREIGN PATENT DOCUMENTS

| | | | |
|---|---|---|---|
| 515949 | 12/1939 | United Kingdom | 432/158 |

*Primary Examiner*—Alexander S. Thomas

*Attorney, Agent, or Firm*—Thomas R. Fitzgerald; Harold S. Wynn

[57] ABSTRACT

A segmented cup-shaped receptacle is provided for completely supporting a melt containing softened crucible, the receptacle having plurality of similar elevational segments. The elevational segments are normally adjoining to provide complete support for the crucible, but are separable to relieve thermal stresses in the crucible and receptacle during cooling to reduce breakage, the crucible and receptacle having different coefficients of expansion. The elevational segments have inwardly formed lower portions adapted to bias the elevational segments inwardly to adjoining positions by gravity for support of sides of the crucible. The receptacle further comprises a central annular base segment adjoining the lower ends of the elevational segments for supporting a central portion of the melt containing crucible. A unitary base plate supports the elevational segments and the central annular base segment, having an outer flange tapered inwardly and downwardly for biasing the elevational segments to positions with their sides adjoining and having their lower ends adjoining the central annular base segment.

5 Claims, 3 Drawing Figures

RECEPTACLE FOR SUPPORT OF A MELT CONTAINING CRUCIBLE

REFERENCE TO PRIOR CASES

This invention is related to prior U.S. Pat. Nos. 3,359,077 and 4,186,046, which are in part incorporated herein by reference for defining background material for the present invention.

BACKGROUND OF THE INVENTION

This invention relates to receptacles for supporting melt containing crucibles, and, while the invention is subject to a wide range of applications, a preferred embodiment of the invention will be particularly described as applied to a receptacle for the support of a melt containing crucible in a furnace for growing crystals.

The present invention can be particularly useful in growing crystals of semi-conductor material, for example, within a furnace, such as is disclosed, for example, in the U.S. Pat. No. 3,359,077. According to this patent, a quartz crucible is provided for containing a silicon melt, the crucible being softened by the temperature of the melt, and being fully supported by a carbon crucible holder, or receptacle. Particularly because of the difference in the coefficient of expansion between the quartz and the carbon materials, the quartz crucible and the carbon receptacle are subject to frequent breakage due to thermal stresses, particularly upon cooling.

An object of the present invention is to provide an improved receptacle for fully supporting a melt containing crucible which substantially obviates one or more of the limitations and disadvantages of the described prior art systems.

Another object of the present invention is to reduce the cost of use of crucibles and their receptacles in crystal growing furnaces by materially reducing the frequency of breakage of these devices.

Other objects, purposes and characteristic features of the present invention will be in part obvious from the accompanying drawings, and in part pointed out as the description of the invention progresses.

SUMMARY OF THE INVENTION

A crucible receptacle is provided that is adapted for complete contact support of a melt containing crucible, which may be in a softened state, wherein the improved receptacle comprises a segmented cup-shaped receptacle for completely supporting the softened crucible. The receptacle has a plurality of similar seperate rigid elevational segments, the sides of which are normally adjoining, but are separable upon cooling to relieve thermal stresses due to different coefficients of expansion of a quartz crucible and the graphite receptacle. The elevational segments have inwardly formed lower portions adapted to bias the elevational segments inwardly to adjoining positions by gravity for support of sides of the crucible.

The receptacle further comprises a central annular base segment of rigid material having its periphery normally adjoining but separable from lower ends of the elevational segments for supporting a central portion of the bottom of the melt containing crucible, the base segment having a generally concave upper surface complementary to a central bottom portion of a crucible.

The receptacle further comprises a unitary base plate of rigid material supporting the receptacle elevational segments and the central annular base segment, wherein the unitary base plate has an inner annular supporting shoulder for the central annular base segment and an outer flange tapered inwardly and downwardly for biasing the elevational segments by gravity to adjoining elevational positions and to positions having their lower ends adjoining the central annular base segment. The segments are thus normally adjoining, but are not secured together, to permit separation of segments to relieve stresses in cooling.

IN THE DRAWINGS

Figure 3:
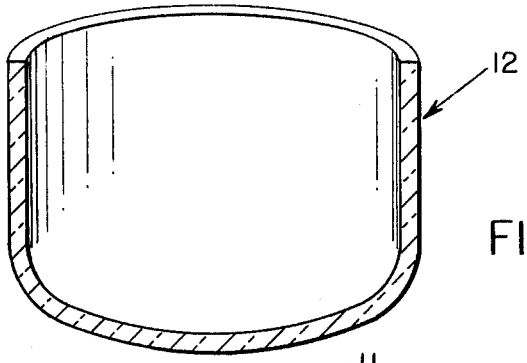
FIG. 3 is an elevational sectional view in perspective of a quartz crucible receivable within the receptacle of FIG. 1.
Figure 1:
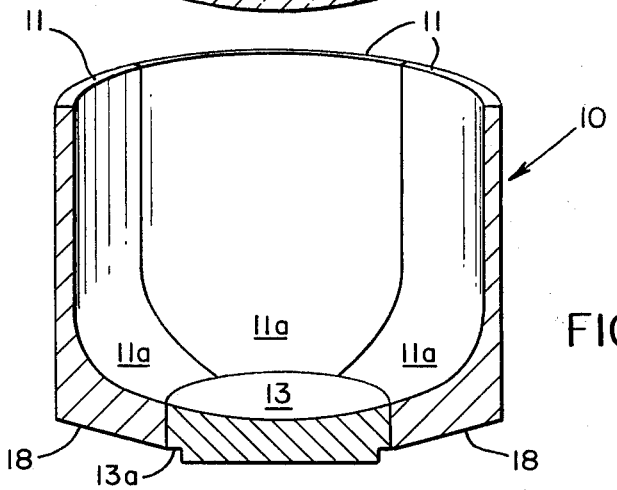
FIG. 1 is an elevational sectional view, in perspective, of a segmented crucible receptacle according to a preferred embodiment of the present invention.

With reference to FIG. 1, a cup-shaped segmented receptacle 10 is illustrated comprising a plurality of similar elevational segments 11 having inwardly formed lower portions 11*a*, adapted to bias the elevational segments 11 to adjoining positions by gravity for support of sides of a quartz crucible 12 (see FIG. 3).

The crucible receptacle 10 further comprises an annular base segment 13 having its periphery in adjoining contact with the lower ends 11*a* of the elevational segments 11. The segments 11 and 13 of the receptacle 10, when adjoining, provide a smooth continuous complementary surface support for the sides and bottom of the quartz crucible 12 shown in FIG. 3.

Figure 2:
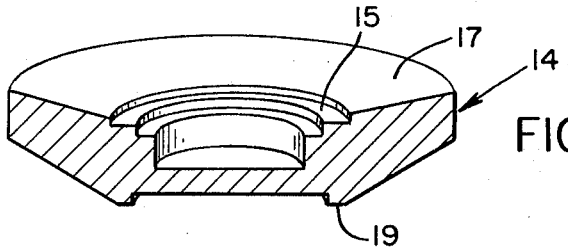
FIG. 2 is an elevational sectional view of perspective of a unitary base plate for supporting the segmented receptacle of FIG. 1.

With reference to FIG. 2, the receptacle 10 further comprises a unitary base plate 14 for supporting the receptacle elevational segments 11 and the central annular base segment 13. The base plate 14 has an inner annular shoulder 15 for support of the annular base segment 13 shoulder 13*a*. The base plate 14 also has an annular flange 17 tapered inwardly and downwardly for cooperating with a complementary lower surface 18 of the elevational segments 11 so as to bias these segments by gravity toward the center of the receptacle, in a closed position, with their sides adjoining. The base plate 14 has an annular rib support 19 adapted to firmly support the crucible on a flat surface (not shown) with a minimum amount of thermal tension with the supporting surface during cooling of the receptacle.

It is proposed that the segmented receptacle 10 will be used to fully support a crucible 12 in a furnace for the growing of crystals, such as the furnace disclosed in the above mentioned U.S. Pat. No. 3,359,077. As the furnace temperature is raised to 1410° C. in order to melt silicon, for example, the quartz crucible 12 softens and conforms to the inner shape of the graphite support receptacle 10. When the process of growing a crystal is finished, the furnace is permitted to cool, and as the receptacle 10 cools, the segments 11 separate to relieve stress and reduce breakage because they contract at a much greater rate than the quartz crucible 12. This is because the graphite of the receptacle 10 has a linear coefficient of expansion of $7.9\times10^{-6}$ while the quartz of the crucible 12 has a coefficient of expansion of only $0.5\times10^{-6}$.

Testing of the segmented receptacle according to the present invention has shown that the useful life of both the quartz crucible and the graphite receptacle has been extended about ten times that of prior art quartz crucibles and receptacles, which generally must be replaced after three or four melts of the furnace.

With the elevational support of the quartz crucible 12 being formed in three or more segments 11 of the receptacle 10, together with a bottom annular segment 13, as the graphite receptacle 10 cools at the end of the crystal growth run of the furnace, the pressure due to contraction of the receptacle 10 at a higher rate than the crucible 12, is alleviated by outward movement of the segments 11. The bottom surface 18 of each of the elevational segments 11 and the top surface 17 of the unitary base plate 14 are at an angle of about 15° to the horizontal to permit the segments to slide outwardly and upwardly, as cooling takes place, to relieve stresses which would otherwise break the graphite recepticle 10. Thus, the angular support of the elevational segments 11, with a bias toward the center of the receptacle 10, serves to provide adequate support for crucible 12, due to gravity, and allows the segments to resist the outward movement of the crucible 12 in a controlled manner. In other words, the angle provides, in conjuncture with gravity, an inward force while opposing the hydrostatic outward force of the liquid silicon.

Further utility of the segmented receptacle 10 is that outside surfaces of commercial quartz crucibles 12 can be rough because of the presence in the outer surface of unfused sand. This is because of the method of manufacture wherein the quartz is fused from heat applied to the inside of the crucible 12 so as to produce a smooth inner surface, while the outer surface may not be fully fused, leaving a rough, and sometimes uneven sand outer surface.

The segmented receptacle 10 can have its segments 11 adjusted to accommodate any roughness, or unevenness of the crucible 12 without creating stress points that may cause breakage of both the crucible 12 and the receptacle 10 during a normal melt process in growing crystals.

Having thus described a segmented receptacle for support of a melt containing crucible as a preferred embodiment of the present invention, it is to be understood that various modifications and alterations may be made to the specific embodiment shown, without departing from the spirit or scope of the present invention.

What is claimed is:

1. A crucible recepticle adapted for complete contact support of a melt containing crucible in a softened state wherein an improved recepticle comprises:

(a) a segmented cup-shaped recepticle for completely supporting the softened crucible comprising a plurality of similar separate rigid elevational segments, (b) the elevational segments being separable to relieve thermal stresses during cooling of the crucible and its supporting recepticle, (c) the segments having inwardly formed lower portions adapted to bias the elevational segments to adjoining positions by gravity for support of sides of the crucible, (d) a central annular base segment adjoining, but separate from lower ends of the elevational segments for supporting a central portion of a melt containing crucible, the base segment being of rigid material and having a generally concave upper surface conforming to a central complimentary bottom portion of the melt containing crucible, and (e) an annular base plate of rigid material for supporting the elevational and base segments having a flange tapered inwardly and downwardly cooperating with a complimentary lower surface of the elevational segments to bias the elevational segments to adjoining positions.

2. A crucible recepticle according to claim 1 wherein the annular base plate for supporting the central annular base segment of the recepticle has an annular shoulder and the base segment has a complimentary cooperating lower surface for supporting and locating the base segment on the base plate.

3. A crucible receptacle according to claim 1 wherein the unitary base plate has an inner annular support for the central annular base segment and an annular outer flange tapered inwardly and downwardly for gravity biasing the elevational segments to adjoining but separable elevational positions and to positions having their lower ends adjoining but separable from the periphery of the central annular base segment.

4. The crucible receptacle according to claim 1 or claim 5 wherein the taper of the flange follows a substantially straight line inwardly and downwardly at a small angle to the horizontal at least in an area supporting the elevational segments.

5. A crucible receptacle according to claim 4 wherein the angle is approximately 15° below the horizontal.

* * * * *